US007134169B2

(12) United States Patent
Habegger et al.

(10) Patent No.: US 7,134,169 B2
(45) Date of Patent: Nov. 14, 2006

(54) HINGE ASSEMBLY AND DOOR MOUNTING SYSTEM INCLUDING SAME

(75) Inventors: Jeffrey D. Habegger, Wadsworth, OH (US); James J. Collene, Bucyrus, OH (US); Steven O. Cummins, Mansfield, OH (US)

(73) Assignee: Mansfield Assemblies Co., Mansfield, OH (US)

( * ) Notice: Subject to any disclaimer, the term of this patent is extended or adjusted under 35 U.S.C. 154(b) by 0 days.

(21) Appl. No.: 10/758,474

(22) Filed: Jan. 15, 2004

(65) Prior Publication Data

US 2005/0155181 A1 Jul. 21, 2005

(51) Int. Cl.
*A47G 27/04* (2006.01)

(52) U.S. Cl. ..... 16/297; 126/194; 126/191; 49/465

(58) Field of Classification Search ..... 16/297, 16/223, 231, 252, 258, 259, 254, 260, 268, 16/270, 272, DIG. 43, 286, 287, 194, 191; 49/465

See application file for complete search history.

(56) References Cited

U.S. PATENT DOCUMENTS

| | | | | | |
|---|---|---|---|---|---|
| 2,921,575 | A | | 1/1960 | Fry | |
| 3,072,117 | A | | 1/1963 | Stoligrosz et al. | |
| 3,150,658 | A | * | 9/1964 | Ferland | 126/191 |
| 3,286,706 | A | | 11/1966 | Hoppe | |
| 3,299,879 | A | * | 1/1967 | Doner | 126/194 |
| 3,327,701 | A | | 6/1967 | Smith | |
| 3,450,125 | A | * | 6/1969 | Hopkins | 126/191 |
| 3,712,287 | A | * | 1/1973 | Summers, Jr. | 126/191 |
| 3,889,654 | A | | 6/1975 | Kauranen et al. | |
| 4,503,582 | A | * | 3/1985 | Gurubatham | 16/232 |
| 5,025,776 | A | * | 6/1991 | Hanley et al. | 126/194 |
| 5,291,634 | A | | 3/1994 | Zanetti | |
| 5,822,925 | A | * | 10/1998 | McKinney et al. | 49/386 |
| 5,881,710 | A | | 3/1999 | Davis et al. | |
| 5,937,481 | A | | 8/1999 | Faringosi | |
| 6,035,848 | A | * | 3/2000 | Ray et al. | 126/194 |
| 6,397,836 | B1 | * | 6/2002 | Pelletier et al. | 126/194 |
| 6,453,510 | B1 | * | 9/2002 | Cummins et al. | 16/343 |
| 6,539,581 | B1 | | 4/2003 | Faringosi | |
| 6,637,319 | B1 | * | 10/2003 | Vanini et al. | 99/467 |
| 6,789,293 | B1 | * | 9/2004 | Habegger et al. | 16/343 |
| 2003/0172920 | A1 | | 9/2003 | Gronbach | |

FOREIGN PATENT DOCUMENTS

| | | |
|---|---|---|
| EP | 0 589 853 A1 | 3/1994 |
| EP | 0 632 180 B1 | 9/1996 |
| EP | 1 039 231 A2 | 9/2000 |

(Continued)

*Primary Examiner*—Brian E. Glessner
*Assistant Examiner*—Mark Williams
(74) *Attorney, Agent, or Firm*—Fay, Sharpe, Fagan, Minnich & McKee, LLP

(57) ABSTRACT

A hinge assembly includes a claw and a body pivotally connected to the claw and movable to and between a first operative position and a second operative position. A link assembly operably interconnects the claw and the body. The link assembly includes at least one link pivotally connected to the claw and a spring connected between the link and an anchor point. A latch is movably connected to the claw, and the latch is movable to and between a locked position where it is adapted to engage an associated mounting receptacle to prevent separation of the claw from the mounting receptacle, and an unlocked position. Te hinge assembly can be provided as part of a door mounting system that also includes a mating mounting receptacle.

17 Claims, 8 Drawing Sheets

FOREIGN PATENT DOCUMENTS

| | | | |
|---|---|---|---|
| EP | 0 810 342 B1 | 8/2001 | |
| EP | 0 738 817 B1 | 3/2002 | |
| EP | 1619442 A1 * | 1/2006 | |

* cited by examiner

HINGE ASSEMBLY AND DOOR MOUNTING SYSTEM INCLUDING SAME

BACKGROUND

The present development relates to a hinge assembly and door mounting system including same, particularly adapted for use in operatively and releasably connecting an appliance door to an appliance body so that the door is manually movable between opened and closed positions relative to a chamber (e.g., a cooking chamber) defined by the body. The hinge assembly and door mounting system are simplified, more reliable and more cost-effective as compared to conventional arrangements.

SUMMARY

In accordance with one aspect of the present deveopment, a hinge assembly comprises a claw and a body pivotally connected to the claw and movable to and between a first operative position and a second operative position. A link assembly operably interconnects the claw and the body. The link assembly comprises at least one link pivotally connected to the claw and a spring connected between the link and an anchor point. A latch is movably connected to the claw, and the latch is movable to and between a locked position where it is adapted to engage an associated mounting receptacle to prevent separation of the claw from the mounting receptacle, and an unlocked position.

In accordance with another aspect of the present development, a door mounting system comprises a hinge assembly and a mounting receptacle adapted to mate with the hinge assembly. The mounting receptacle comprises a base defining an opening having a lower edge and an upper edge. The hinge assembly comprises a claw that is adapted for insertion into the opening of the mounting receptacle to couple the hinge assembly to the mounting receptacle. A body is pivotally connected to the claw and movable to and between a first operative position and a second operative position. A link assembly operably interconnects the claw and the body. A latch is movably connected to the claw and is movable to and between a locked position where it prevents separation of the claw from the mounting receptacle, and an unlocked position.

BRIEF DESCRIPTION OF DRAWINGS

The development comprises various components and arrangements and combinations of components as described herein with reference to the accompanying drawings wherein.

DETAILED DESCRIPTION

Figure 1:
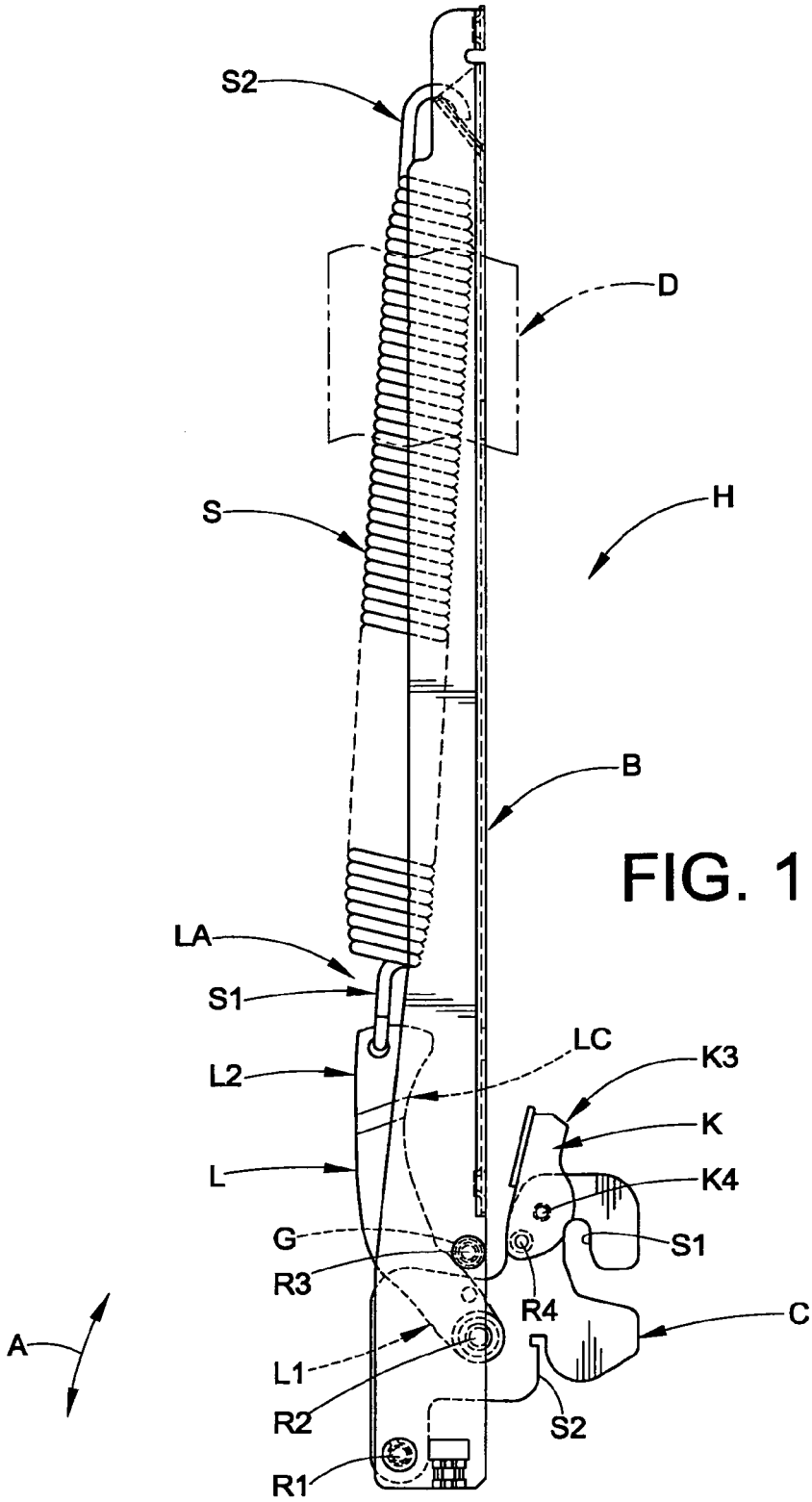
FIG. 1 is a side view of a hinge assembly formed in accordance with the present development in its first operative position.
Figure 2:
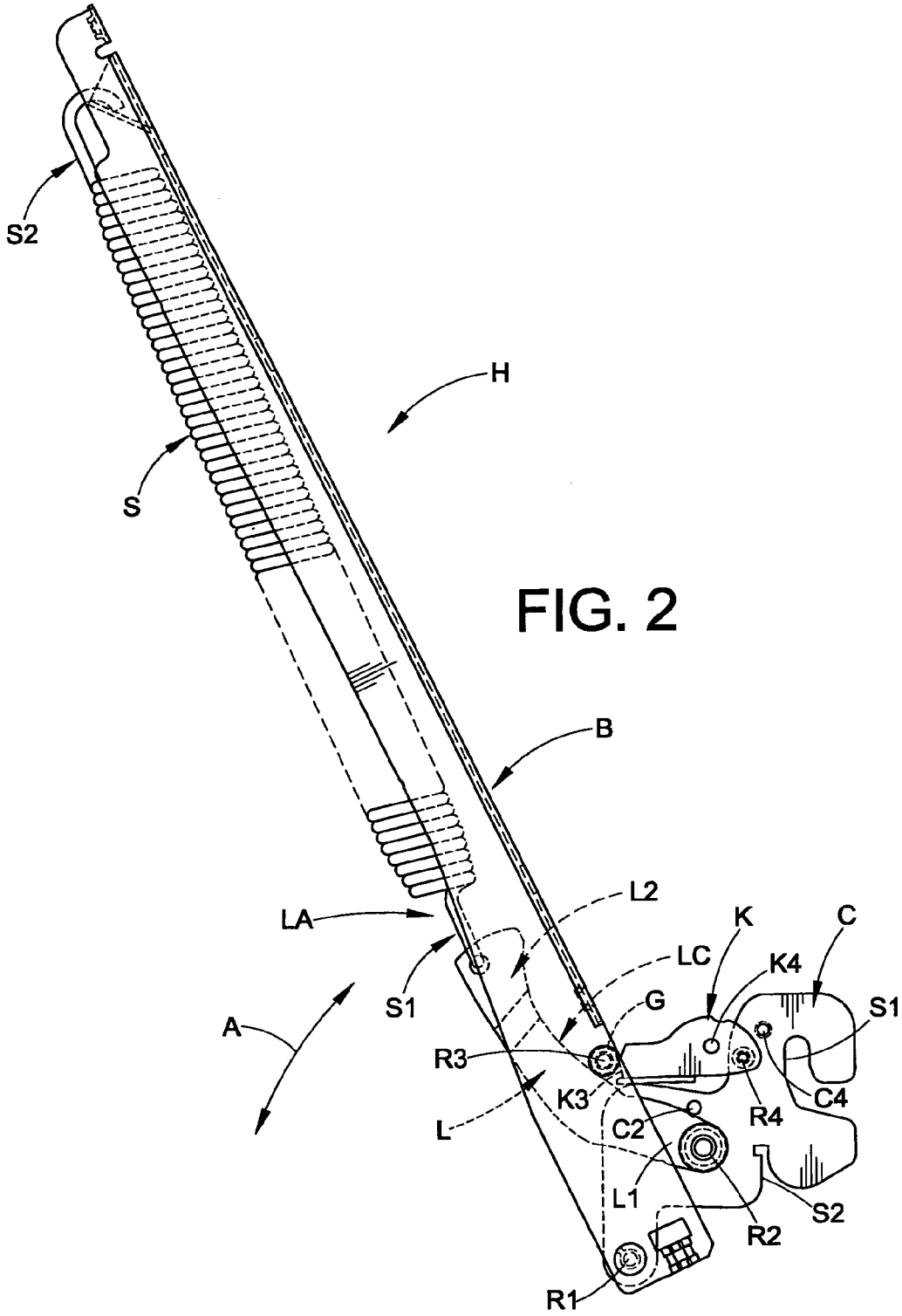
FIG. 2 is similar to FIG. 1 but shows the hinge assembly in its install/remove position.
Figure 3:
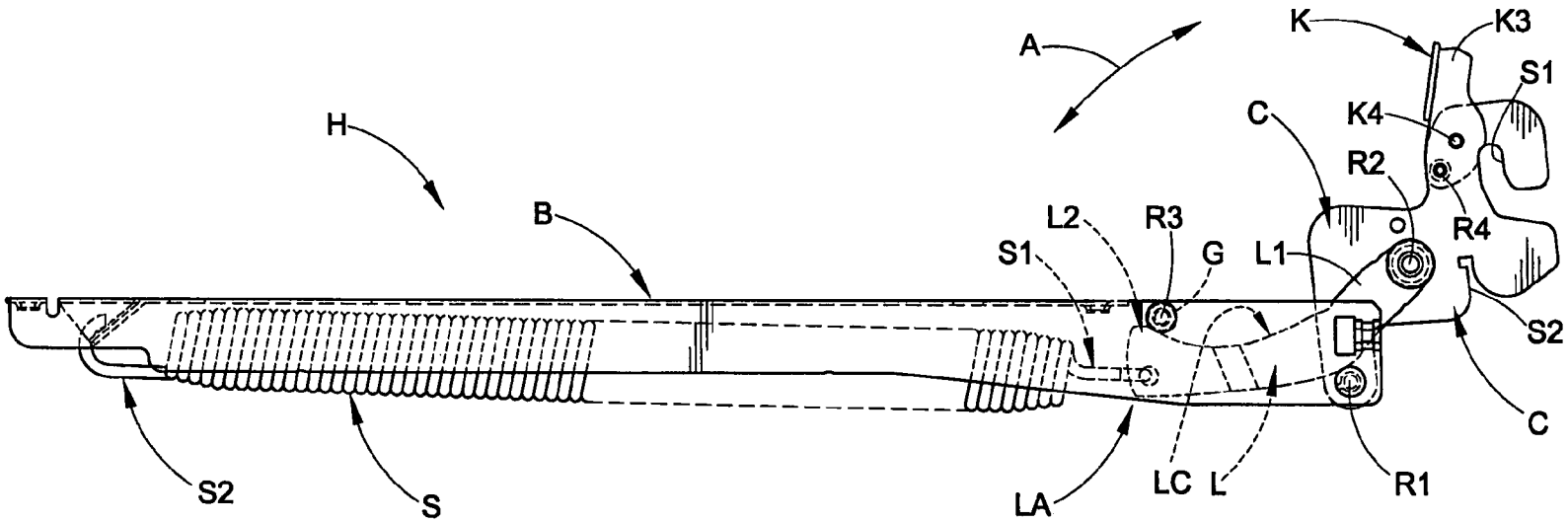
FIG. 3 shows the hinge assembly in its second operative position.

FIGS. 1–3 show a hinge assembly H formed in accordance with the present development. The hinge assembly H comprises a hanger or claw C adapted to be releasably connected to a mating receptacle M (FIG. 4) that is connected to and/or formed as a part of an appliance body. To this end, the claw C comprises one or more slots S1,S2 defined therein that receive portions of the mating receptacle. The claw C is preferably defined as a one-piece metal stamping construction, but other materials (e.g., polymeric) and/or methods of manufacture (e.g., multi-piece assemblies, forgings, castings, extrusions, etc.) are contemplated.

A hinge body or channel B, defined from the same or similar materials as the claw C, is pivotally connected to the claw C by a pin or rivet R1 or other fastener so that the channel B is adapted to pivot relative to the claw along an arc A to and between at least a first operative position as shown in FIG. 1 and a second operative position as shown in FIG. 3. When the hinge assembly H is in use, typically as part of a pair, an appliance door D (shown in phantom lines in FIG. 1) is connected to the body B thereof and moves therewith on the arc A between a closed position that corresponds to the first operative position of the body B and an opened position that corresponds to the second operative position of the body. The body B can also be positioned in one or more intermediate positions located between the first and second operative positions and, typically, the hinge body B and door D will counterbalance in at least one such "intermediate" position so as to define a partially opened "broil" position for the door D.

Figure 5:
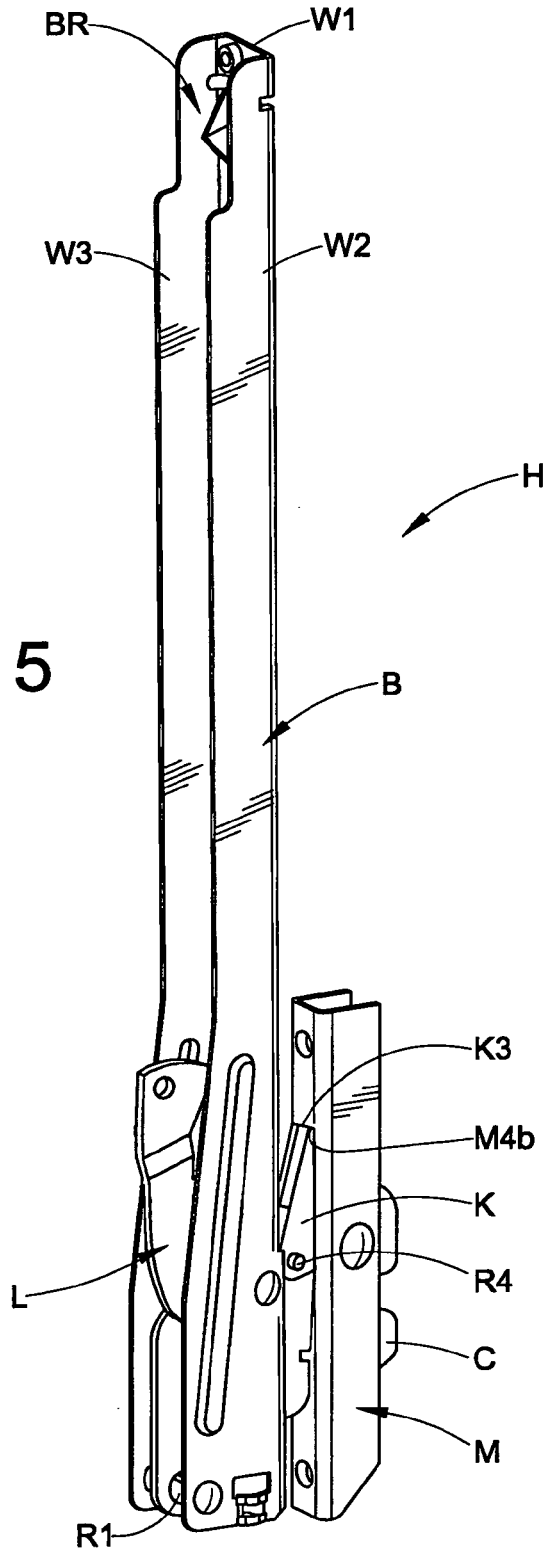
FIGS. 5 and 6 are isometric views that correspond respectively to FIGS. 1 and 2 and show the hinge assembly operatively connected to the mounting receptacle of FIG. 4 (the biasing spring of the hinge assembly is not shown)
Figure 6:
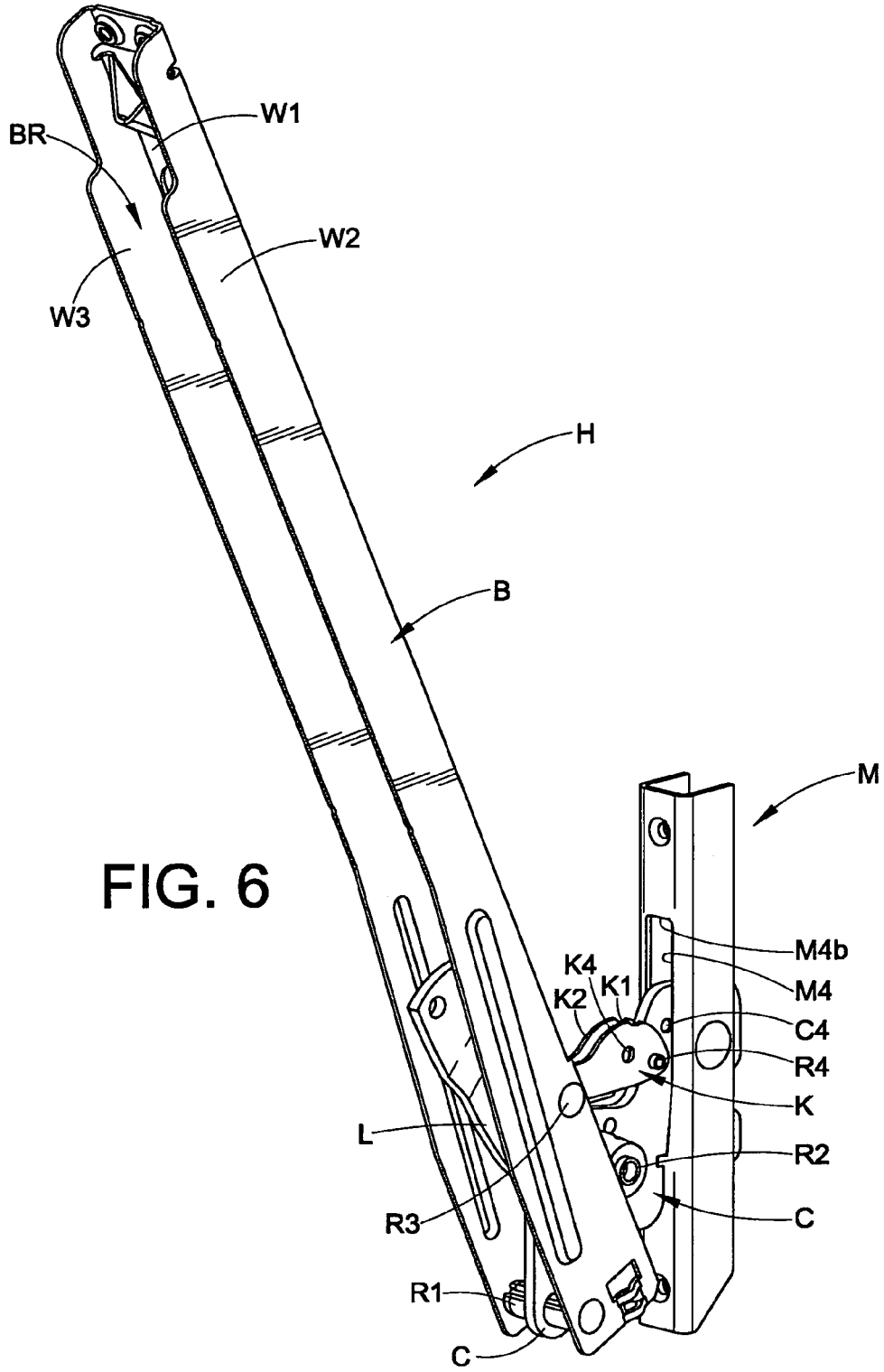

With brief reference to FIGS. 5 and 6, it can be seen that the hinge body B preferably defines a U-shaped channel, typically defined by a stamping operation, having an inner wall W1 and first and second sidewalls W2,W3, between which an open recess BR is defined. The wall W1 of body includes openings to allow the claw C and related components described below to pass therethrough as required for operation of the hinge assembly. The body B is preferably U-shaped for strength, ease of manufacture, and weight/material reduction.

The claw C and the channel/body B are also operably interconnected through a link assembly LA comprising at least one link L and a spring S. The link has a first end L1 that is pivotally connected to the claw C by way of a rivet R2 or other fastener or means. The link member L is connected at its opposite, second end L2 to a first end S1 of the spring S by way of a hook formed in the first end of the spring that is engaged with an aperture or other structure defined by the link L. The opposite, second end S2 of the spring S is connected to the channel B or other anchor point (e.g., the door D) by way of a hook formed in the second end S2 of the spring S. As shown herein, the spring S is a tension coil spring defined from metal wire. Other types of springs, e.g., compression springs, and materials, e.g., polymeric materials, are contemplated.

The link L comprises a cam surface LC that engages a guide G that is secured to the body B and that spans the recess BR. In the illustrated embodiment, the guide G comprises a roller or sleeve secured to the body B by way of rivet R3 or other fasteners that extends coaxially therethrough.

The spring S biases the channel B toward/into its first operative position as shown in FIG. 1. When the required manual force is applied to the body B, typically via attached door D, the body pivots on the arc A toward its second operative position while the spring S elongates and the link L moves relative to the guide G with the cam surface LC of the link L in contact with the guide. With reference to FIG. 3, pivoting movement of the body B from its first operative position (FIG. 1) to the second operative position (FIG. 3) on the arc A is limited by a stop. In the illustrated embodiment, the fastener R1 defines such a stop that abuts the link L as shown in FIG. 3 to prevent further pivoting movement of the body B away from the first operative position on the arc A. In another embodiment, the link cam surface LC defines a dwell point for receiving/retaining the guide G in order to define a stop. Of course, the hinge body B can be made to abut a tab of the claw to define a stop.

The hinge assembly H further comprises a latch K pivotally connected to the claw C by a rivet R4 or other fastener. As shown herein, latch K comprises at least one and preferably two tabs K1,K2 (FIG. 6) positioned to sandwich the claw C closely there between. The tabs K1,K2 can be defined separately or as a one-piece construction (e.g., U-shaped). The latch K pivots about the fastener R4 between a first or "locked" position shown in FIGS. 1 and 3 and a second or "unlocked" position as shown in FIG. 2. The latch K comprises a head K3 defined at a distal end spaced from the fastener R4. With reference to FIG. 2, when the hinge body B is moved to an install/remove position on the arc A and the latch K is moved to its second "unlocked" position, the head K3 of latch K engages the guide G and prevents movement of the body B under force of spring S or otherwise on the arc A toward its first operative position, which is useful for a purpose described below. Owing to the biasing force of spring S, the body B and guide G are urged into and maintained in engagement with the latch K until the body B is manually moved toward its second operative position so that the latch K can be moved back to its first, "locked" position. The unlocked position for the latch K is conveniently defined by the position of the latch when it abuts the claw C. This eliminates the need for a user to carefully move the latch K into the unlocked position. Instead, the latch K is simply pivoted until it abuts the claw C. Also, the shape of the head K3 is such that the force of the guide G bearing against it causes the latch K to bear against the claw C instead of away from the claw to prevent undesired movement of the latch out of the unlocked position under force of spring S or otherwise. As an alternative to engaging the guide G to hold the body B in the install/remove position against the force of spring S, the latch K directly engages the body B and/or the door D connected to the body B when the latch K is moved to its unlocked position and thus prevents movement of the body B to its first operative position.

The latch K is preferably resistant to movement out of its first "locked" position. This resistance can be provided by friction between the latch K and claw C, a detent mechanism or other means. The latch K optionally defines a throughbore K4 that is aligned with an optional aperture C4 of the claw, and a pin or other member (not shown) can be inserted through these aligned openings to immobilize the latch K in its first position. Also, it should be noted that the claw defines an opening C2 (FIG. 2) into which a pin, rivet or other stud-like member can be inserted temporarily when the body B is moved to its install/remove position to block movement of the body B from the install/remove position to the first operative position under force of spring S as an alternative to use of latch K, if desired.

Figure 4:
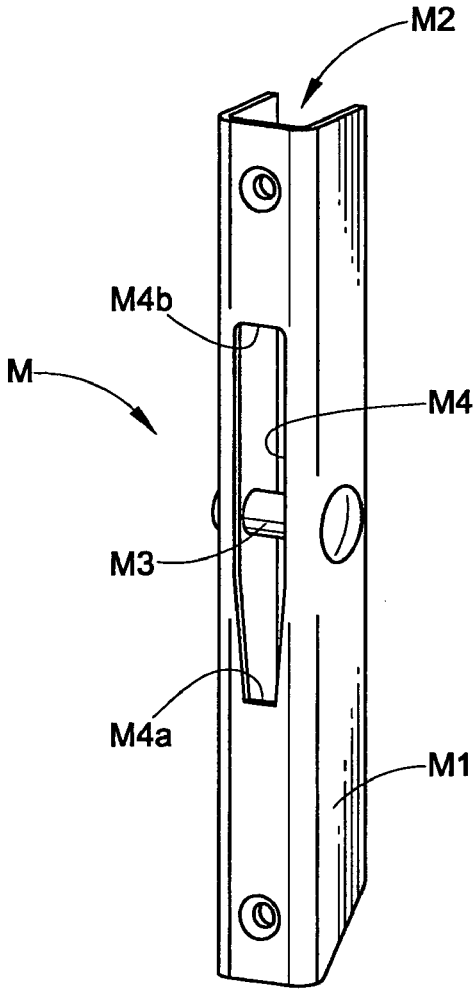
FIG. 4 is an isometric view of a mounting receptacle adapted to receive and retain the hinge assembly of FIG. 1 and that forms a part of a door mounting system in accordance with the present development.

FIG. 4 illustrates a mounting receptacle M that, together with the hinge assembly H, forms a door mounting system in accordance with the present development. The mounting receptacle M is defined by and/or connected to an oven or other appliance body O (FIGS. 7 and 8) and, typically, a pair of mounting receptacles M are provided adjacent opposite sides of a cooking chamber or other opening of the body O and are adapted to mate with respective hinge assemblies H.

With continuing reference to FIG. 4, the mounting receptacle comprises a base Ml shown as a U-shaped member defining a recess M2. As with the body B of hinge assembly H, the base M1 is preferably defined by a U-shaped channel member for strength, reduced weight and ease of manufacture/assembly. In the illustrated embodiment, the base M1 comprises a stamped metal member, but it can also be defined by an extrusion or can be otherwise defined. A pin, rivet, fastener or other mounting member M3 (referred to herein as mounting pin M3) spans the recess M2. The central wall of base M1 defines a mounting slot or opening M4 partially defined by a lower region/edge M4*a* and an upper region/edge M4*b*. The mounting opening M4 is dimensioned to receive the claw C of a hinge assembly H. When the claw C is inserted into the opening M4, the mounting pin M3 is received in the first slot S1 of the claw C and the lower edge M4*a* of slot M4 is received into the second slot S2 of the claw C. This result is shown in FIGS. 5–8 wherein the claw C is fully mated to the mounting receptacle M4. In an alternative embodiment, the mounting receptacle comprises two of the mounting pins M3 for respective receipt in the slots S1,S2 of claw C.

Those of ordinary skill in the art will recognize that mating and separation of the claw and mounting receptacle requires movement (typically vertical movement) of the claw C in the mounting opening M4 toward and away from the lower and upper edges M4*a*, M4*b* thereof. More particularly, to connect the claw C to the mounting receptacle M4, the claw must move downward toward lower edge M4*a* so that the slots S1,S2 of the claw receive the mounting pin M3 and edge M4*a*, respectively. For decoupling, the claw C must be moved in the opening M4 toward the upper edge M4*b* to disengage the pin M3 and edge M4*a* from the respective slots S1,S2 of claw C. The latch K of the hinge assembly H is used selectively to prevent movement of the claw C within the opening M4 required to decouple the claw from the mounting receptacle.

Figure 7:
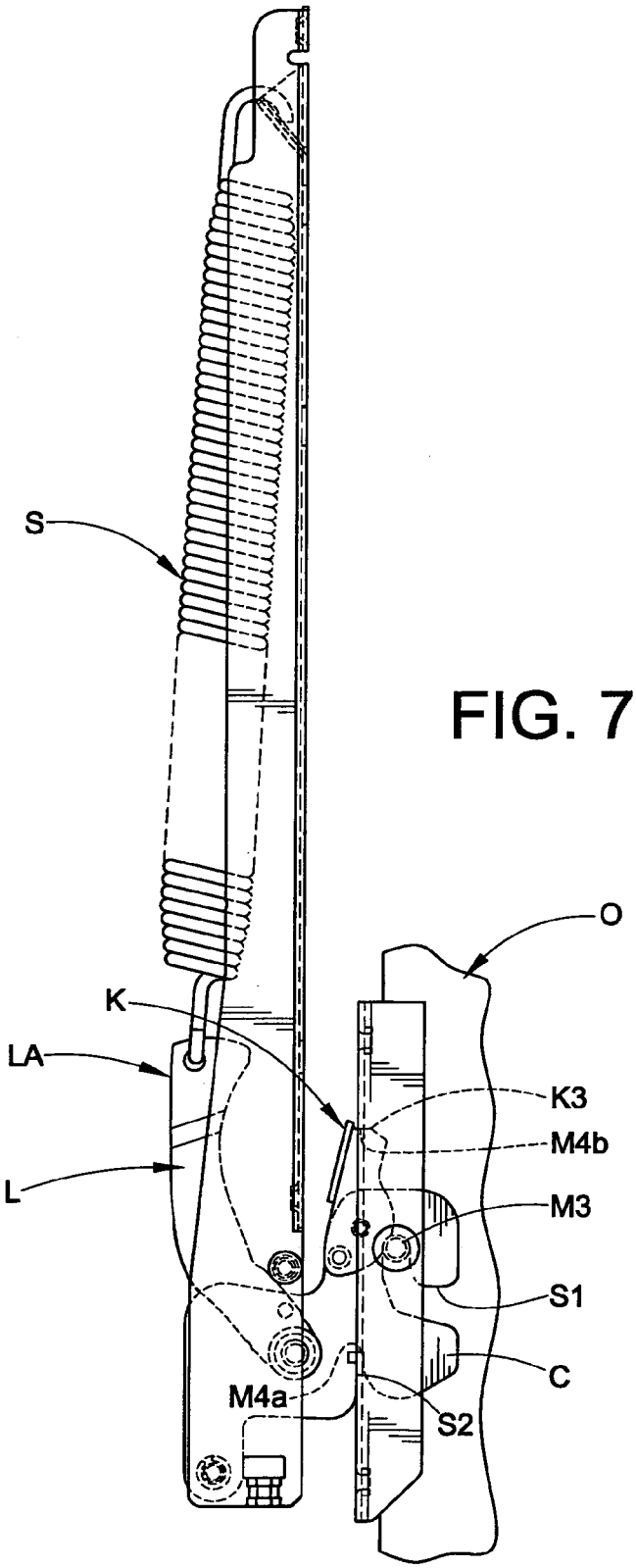
FIGS. 7 and 8 are side elevational views that show the hinge assembly as in FIGS. 1 and 3, respectively, and that show the hinge assembly operably mated to the mounting receptacle of FIG. 4.
Figure 8:
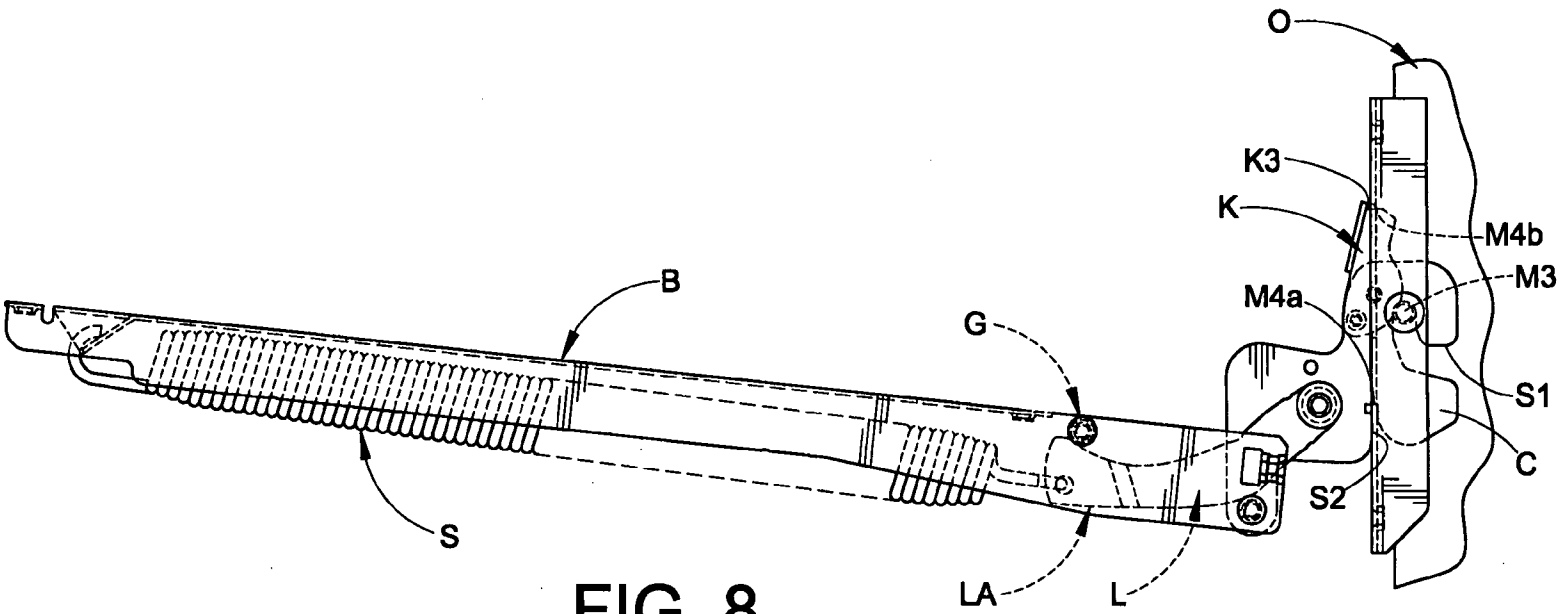

More specifically, the claw C is easily mated with or decoupled from the mounting receptacle when the latch K is in its second, "unlocked" position and, in particular, when the latch K is used to retain the body B of the hinge assembly in its install/remove position as shown in FIGS. 2 and 6 and as described above. Once the claw C is fully mated with mounting receptacle M, the body B of the hinge assembly is moved sufficiently toward its second operative (opened) position so that the latch K can be pivoted to its first, "locked" position as shown in FIGS. 5, 7 and 8. There, it can be seen that when the latch K is moved to the "locked" position, the head K3 thereof abuts or lies adjacent the upper edge M4*b* of the opening M4 so that the head K3 contacts the edge M4*b* upon attempted decoupling of the claw C from the mounting receptacle M to prevent movement of the claw in the opening M4 as required to separate the claw from the mounting receptacle M. In this manner, when the latch K is in its first, "locked" position, it prevents decoupling of the claw C from the mounting receptacle M. Of course, the latch K is simply moved out of its first position to its second, "unlocked" position or to some intermediate position when separation of the claw C from the mounting receptacle is desired.

It is important to note that the latch K is also self-locating insofar as the locked position is concerned. When the claw C is mated with the mounting receptacle M, the locked position of latch K is defined when the latch is pivoted until it abuts the mounting pin M3 of the mounting receptacle M.

The development has been described with reference to preferred embodiments. It is not intended that the claims be construed in a manner that limits the scope thereof to the preferred embodiments. Instead, the claims should be construed in the broadest possible manner allowed by law both literally and according to the doctrine of equivalents.

The invention claimed is:

1. A hinge assembly comprising:

a claw adapted to be inserted into an associated mounting receptacle between upper and lower edges of an opening defined by the associated mounting receptacle, wherein said claw comprises first and second slots defined therein that are adapted for engaging respective first and second portions of the associated mounting receptacle;

a body pivotally connected to the claw and movable to and between a first operative position and a second operative position;

a link assembly operably interconnecting the claw and the body, said link assembly comprising at least one link pivotally connected to the claw and a spring connected between said link and an anchor point;

a latch movably connected to said claw, said latch movable to and between a locked position where the latch is adapted to engage the upper edge of the opening of the associated mounting receptacle to prevent separation of said claw from the associated mounting receptacle without obstructing either of said first and second slots, and an unlocked position, where the latch obstructs return movement of the body from its second operative position into its first operative position.

2. The hinge assembly as set forth in claim 1, further comprising:

a cam surface defined by said link; and, a guide connected to said body, wherein said cam surface of said link movably engages said guide when said body moves between said first and second operative positions.

3. The hinge assembly as set forth in claim 2, wherein said latch, when located in its unlocked position, engages said guide to block movement of the body into its first operative position.

4. The hinge assembly as set forth in claim 1, wherein said latch comprises first and second tabs that sandwich the claw there between.

5. The hinge assembly as set forth in claim 1, wherein said anchor point for said spring is located on said body of said hinge assembly.

6. The hinge assembly as set forth in claim 1, further comprising:

a first fastener that pivotally interconnects said body to said claw, wherein said at least one link engages said first fastener when said body is moved to its second operative position.

7. The hinge assembly as set forth in claim 1, wherein said spring comprises a metal coil spring that elongates when said body moves from its first operative position to its second operative position.

8. A door mounting system comprising:

a hinge assembly; and, a mounting receptacle adapted to mate with said hinge assembly, said mounting receptacle comprising a base defining an opening having a lower edge and an upper edge;

wherein said hinge assembly comprises:

a claw that is adapted for insertion into said opening of said mounting receptacle to couple said hinge assembly to said mounting receptacle, said claw comprising first and second slots defined therein to receive respective first and second portions of said mounting receptacle;

a body pivotally connected to the claw and movable to and between a first operative position and a second operative position;

a link assembly operably interconnecting the claw and the body;

a latch movably connected to said claw, said latch movable to and between a locked position and an unlocked position, wherein said latch, when in its locked position, engages said upper edge of said mounting receptacle opening without obstructing either of said first and second slots to limit movement of said claw in said opening thereby preventing decoupling of said claw from said mounting receptacle.

9. The door mounting system as set forth in claim 8, wherein said latch prevents said body from moving from its second operative position to its first operative position when said latch is located in its unlocked position.

10. The door mounting system as set forth in claim 9, wherein said link assembly comprises a link pivotally connected to said claw and a spring connected between said link and an anchor point, said link comprising a cam surface and said hinge assembly further comprising a guide connected to said body that engages said cam surface when said body moves between said first and second operative positions.

11. The door mounting system as set forth in claim 10, wherein said latch, when located in its unlocked position, engages said guide or said body or an appliance door connected to said body and prevents movement of said body from said second operative position to said first operative position.

12. The door mounting system as set forth in claim 10, wherein said anchor point for said spring is located on said body of said hinge assembly.

13. The door mounting system as set forth in claim 12, further comprising:

a first fastener that pivotally interconnects said body to said claw, wherein said link engages and, stops against said first fastener when said body is moved to its second operative position.

14. The door mounting system as set forth in claim 8, wherein said latch comprises first and second tabs that sandwich said claw there between.

15. The door mounting system as set forth in claim 8, wherein said mounting receptacle further comprises a mounting pin, and wherein said claw comprises first and second slots defined therein that are adapted for respectively receiving said mounting pin and said lower edge of said opening of said mounting receptacle.

16. The door mounting system as set forth in claim 15, wherein said spring comprises a metal coil spring that elongates when said body moves from its first operative position to its second operative position.

17. The door mounting system as set forth in claim 8, wherein said base of said mounting receptacle and said body of said hinge assembly each comprises a U-shaped cross-section.

* * * * *